US007191548B2

(12) United States Patent
Salameh et al.

(10) Patent No.: US 7,191,548 B2
(45) Date of Patent: Mar. 20, 2007

(54) CLOTHES TUMBLER WITH OZONE GENERATOR

(75) Inventors: Naom Salameh, Louisville, KY (US); Stanley T. Wheeler, Louisville, KY (US); Judith P. Folk, Chapin, SC (US)

(73) Assignee: Cissell Manufacturing Company, Louisville, KY (US)

( * ) Notice: Subject to any disclaimer, the term of this patent is extended or adjusted under 35 U.S.C. 154(b) by 0 days.

(21) Appl. No.: 11/232,544

(22) Filed: Sep. 22, 2005

(65) Prior Publication Data

US 2006/0064893 A1 Mar. 30, 2006

Related U.S. Application Data

(60) Provisional application No. 60/612,845, filed on Sep. 24, 2004.

(51) Int. Cl.
*F26B 7/00* (2006.01)

(52) U.S. Cl. ..... 34/380; 34/595; 34/601; 96/153; 95/143

(58) Field of Classification Search ..... 34/380, 34/381, 108, 595, 596, 601, 602; 96/153; 95/127

See application file for complete search history.

(56) References Cited

U.S. PATENT DOCUMENTS

| | | | | |
|---|---|---|---|---|
| 3,065,620 | A * | 11/1962 | Houser | 68/13 R |
| 3,226,842 | A * | 1/1966 | Morey | 34/72 |
| 4,988,484 | A * | 1/1991 | Karlson | 422/186.19 |
| 5,141,722 | A | 8/1992 | Nagashima | |
| 5,369,892 | A | 12/1994 | Dhaemers | |
| 5,546,678 | A | 8/1996 | Dhaemers | |
| 5,713,137 | A | 2/1998 | Fujita | |
| 6,134,806 | A | 10/2000 | Dhaemers | |
| 6,607,672 | B2 | 8/2003 | Koslow et al. | |
| 2001/0055541 | A1 | 12/2001 | Smith | |
| 2003/0080068 | A1 | 5/2003 | Koslow et al. | |

* cited by examiner

*Primary Examiner*—S. Gravini
(74) *Attorney, Agent, or Firm*—Polster, Lieder, Woodruff & Lucchesi, L.C.

(57) ABSTRACT

A tumbler is provided for removing odors, such as smoke, from clothing. The tumbler comprises a rotating basket in which clothing tumbles, a blower which causes air to flow through said basket and an ozone source which releases ozone into the air which flows into the basket. The tumbler includes a controller which activates the ozone source after the basket and blower have been activated; and continues to operate the blower and basket after deactivation of the ozone source to provide for a purge period.

26 Claims, 4 Drawing Sheets

CLOTHES TUMBLER WITH OZONE GENERATOR

CROSS-REFERENCE TO RELATED APPLICATIONS

This application claims priority to U.S. Provisional Application No. 60/612,845 filed Sep. 24, 2004, entitled "Method And Apparatus For Eliminating Odors From Fabrics" and which is incorporated herein by reference.

STATEMENT REGARDING FEDERALLY SPONSORED RESEARCH OR DEVELOPMENT

Not Applicable.

BACKGROUND OF THE INVENTION

The present invention relates to fabric deodorization devices, and, in particular to a tumbler which introduces ozone into the tumbler basket to remove odors, such as smoke odors, from the fabric within the tumbler.

Odors, such as from fire smoke are typically difficult to remove from clothing. Heretofore, clothing which suffered smoke damage in a fire was discarded. However, the insurance industry has recognized that it is often less expensive to remove the smoke odor from smoke damaged clothing, than to replace the clothing altogether.

Typically, the smoke odor is removed from clothing by placing the clothing in a large chamber, such as by hanging the clothing in the chamber, and exposing the clothing to ozone for an extended period of time, typically 24–48 hours. Because of the size and cost of the equipment typically used to remove smoke odors from clothing, there are typically only a few businesses in larger metropolitan areas that have the equipment to remove smoke odors from clothing.

BRIEF SUMMARY OF THE INVENTION

We have determined that the length of time required to remove smoke odors from clothing is substantially reduced if the clothes are tumbled while being exposed to ozone. Further, the treatment time can be reduced even further if the ozone is flowed around the tumbling clothes. For example, by forcing an air stream containing ozone through a rotating tumbler of dry clothing, exposure time can be reduced to less than about 50 minutes. Depending on the amount of smoke odor in the clothing and the type of fabric from which the clothing is made, the exposure time to the ozone can be reduced to one-half hour or even less. The action of tumbling the dry clothing helps distribute the ozone throughout the clothing or garments being treated in the tumbler, to provide a better interaction between the clothing to be treated and the ozone.

Hence, in accordance with one aspect of the present invention, a tumbler is provided with a source of ozone. The tumbler includes a rotatable basket or chamber which receives clothing to be treated. A blower forces an air stream containing ozone through the tumbling clothes. The tumbler is controlled such that the ozone source is not activated to release ozone until after the blower has been activated. The controller also provides for a purge period, after a treatment cycle, wherein the ozone source is deactivated and only ambient (fresh) air is passed through the basket. The tumbler can, if desired, include a heater which introduced heated air into the chamber to dry the clothing. In this instance, the ozone is not activated until after the clothing is dried, so that dried clothing is treated by the ozone.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 4:
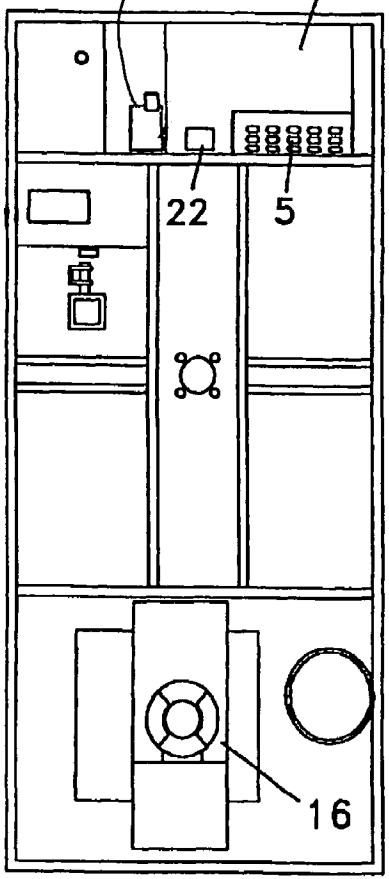
FIG. 4 is a rear elevational view of the tumbler.
Figure 3:
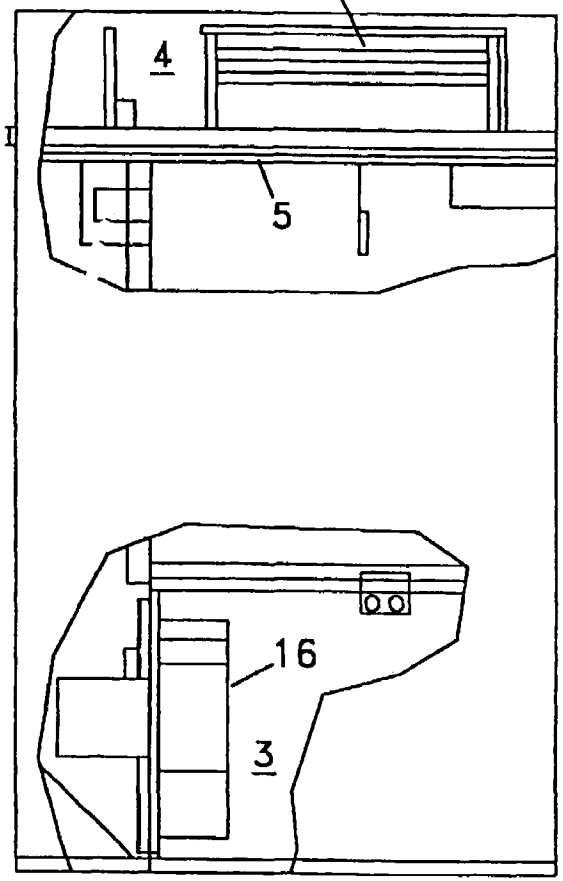
FIG. 3 is a side elevational view of the tumbler, partially cut-away to show internal elements of the tumbler.
Figure 1:
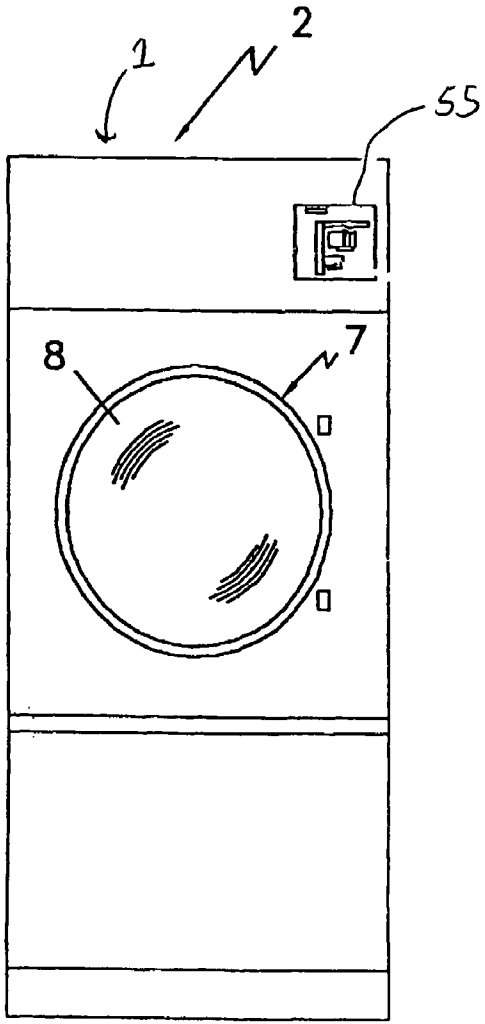
FIG. 1 is a front elevational view of a tumbler incorporating the present invention.
Figure 2:
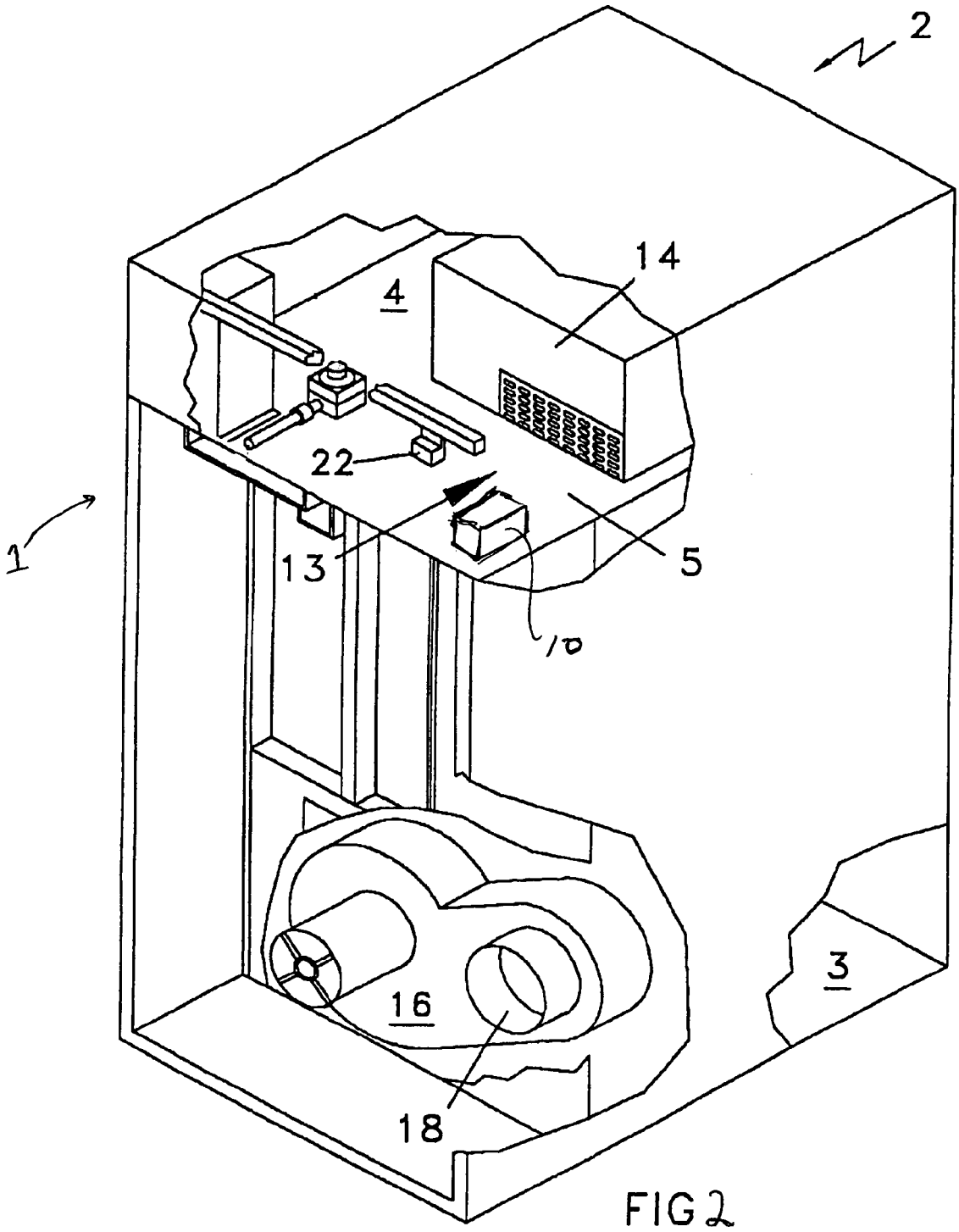
FIG. 2 is a perspective, cut-away view of the tumbler.

The following detailed description illustrates the invention by way of example and not by way of limitation. This description will clearly enable one skilled in the art to make and use the invention, and describes what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 5:
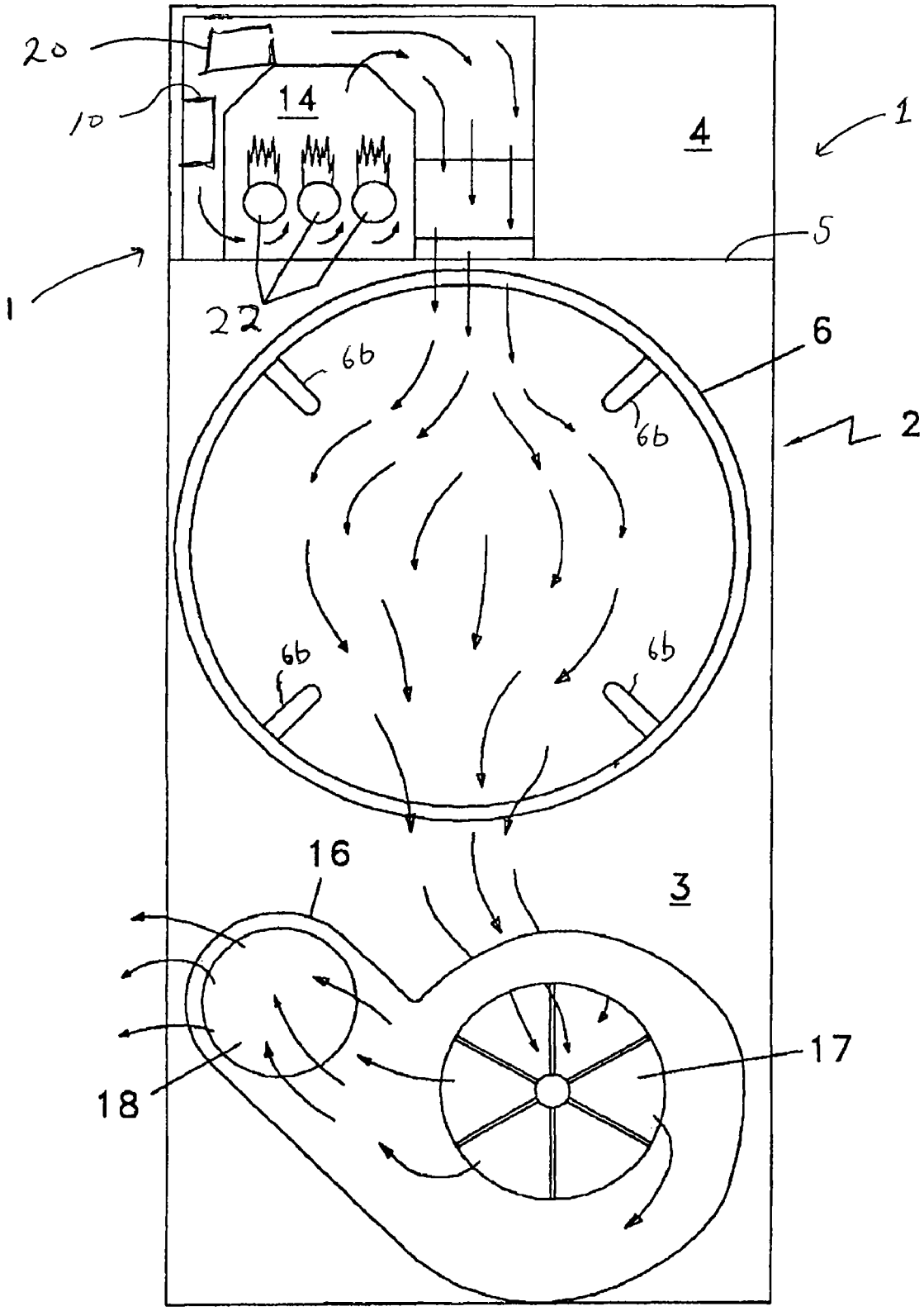
FIG. 5 is a schematic view of the tumbler showing the air flow through the tumbler.

A tumbler 1 is shown generally in FIGS. 1–5. The tumbler 1 includes a housing 2, which can be formed from any one of several strong, substantially rigid materials, such as a suitably coated sheet metal. The housing 2 is shown to be rectangular in elevational view, but can be made in other configurations if so desired. The housing 2 defines a lower, tumbling chamber 3 and an upper chamber 4 separated by horizontal partition 5. As can be seen in the broken away schematic view of FIG. 5, tumbling chamber 3 includes a perforated basket 6 which holds the clothing to be treated. The basket is rotatably mounted in the housing 2 and is rotated by a basket motor 6*a*. As seen in FIG. 5, the basket is provided with baffles 6*b* which extend inwardly from the basket wall. As is known, the baffles 6*b* facilitate tumbling of the clothing within the basket during rotation of the basket. The clothing to be treated are passed to basket 6 through the hinged door 7 at the front end of housing 2. The door 7 can be provided with a transparent glass or plastic material viewing sealed porthole 8 (FIG. 1) if desired.

The tumbler 1 includes an ozone source 10 which introduces ozone ($O_3$) into the upper chamber 4. The ozone source 10 can be a tank of ozone or an ozone generator. If an ozone tank is provided, then the ozone source 10 can be positioned externally of the housing 2 to facilitate replacement or refilling of the ozone tank. In this instance, the housing would include a connector to receive tubing to connect the ozone tank to the tumbler. Additional tubing in the tumbler housing would then direct ozone from the tank to the upper chamber 4. A valve would be positioned in the internal tubing. The valve would be switchable moved between an open position in which ozone could pass from the ozone tank to the upper chamber 4, and a closed position in which ozone would be prevented from entering the upper chamber 4. On the other hand, if an ozone generator is provided, the ozone generator can be positioned within the upper chamber 4. The chamber 4 is provided with a rear chamber inlet 13 (FIG. 2) through which an ambient air can be introduced into chamber 4.

A heating unit 22 can also be provided in the upper chamber 4. The heating unit can be a gas fired heater, a steam heater or an electric heater.

The chamber 4 can also include a secondary chamber 14. The ozone generator 10 can be positioned within this secondary chamber 14, or piping can introduce ozone from the ozone tank into the secondary chamber 14. The heating unit 22 can also be positioned in this secondary chamber 19. If desired, the secondary chamber 14 can be omitted, in which case, there is a single upper chamber 4 into which ozone and ambient air are delivered. In either event, the ambient air introduced into the upper chamber 4 entrains the ozone from the ozone source, to produce an ozone containing air stream.

The tumbler 1 can also include an air dehumidifying unit 20 to provide dehumidified air. The air dehumidifying unit is positioned to deliver dehumidified air to the basket. The ozone produced by the ozone generator 10 is mixed with the dehumidified air either prior to, or upon introduction of, the ozone into the basket.

A rotatable centrifugal blower 16, driven by a blower or fan motor 16*a*, is disposed in a lower portion of the housing lower chamber 3. The blower 16 serves to draw the ozone containing air stream from the upper chamber 4 into the lower chamber 3. The blower pulls the ozone containing air stream through motor driven rotatable perforated basket 6 over the fabric materials received in the basket 6 and ultimately through the blower inlet 17 of blower 16 (FIG. 5) and through an exhaust outlet 18 in housing 2. The blower motor speed for blower 16 can operate in the low frequency range of approximately 30 Hz to a high frequency range of approximately 60 Hz.

Figure 6:
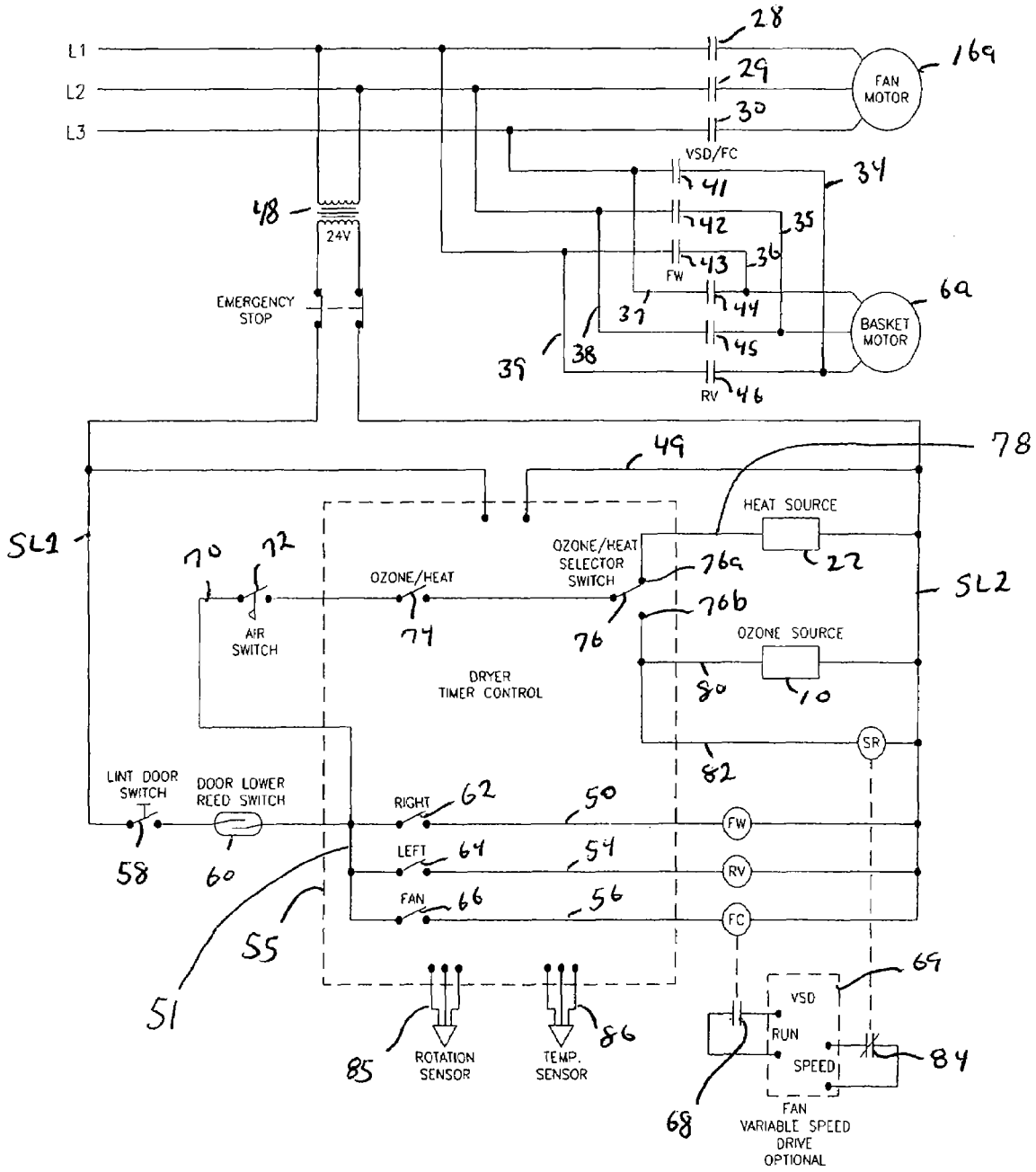
FIG. 6 is an electrical schematic for the tumbler.

The circuitry 26 for the tumbler 1 is shown in FIG. 6. The circuitry 26 includes a 3-phase line comprised of lines L1, L2, L3 which are connectable to a source of electricity of appropriate voltage. Lines L1, L2, L3 are directly connected to fan or blower motor 16*a* for the centrifugal fan or blower 16 through normally open fan drive or variable speed drive contacts 28, 29, and 30 respectively.

The basket motor 6*a* is also connected across lines L1, L2 and L3. As can be seen, basket motor 6*a* is connected in parallel to fan motor 6*a* and to the three-phase lines L1, L2 and L3, through line set 34, 35 and 36 and line set 37, 38 and 39 respectively, with suitable sets of normally open forward drive contacts 41, 42 and 43 and normally open reverse contacts 44, 45, and 46 being employed in the line sets 34–36 and 37–39, respectively.

Connected across lines L1, L2 of the three phase line L1, L2 and L3 through a 24V step-down transformer 48 are step down lines SL1 and SL2. Two lines 49 and 50 extend between SL1 and SL2. A line 51 extends from line 50, and two additional lines 54 and 56 extend between lines 51 and SL2 (such that lines 54 and 56 are in parallel with line 50). A lint door switch 58 and a door lower reed switch 60 are placed in line 50. As can be appreciated, the tumbler will not be activatable unless the switches 58 and 60 are closed (i.e., if the lint door is closed and the tumbler door 7 is closed).

A timer control 55, such as described in U.S. Pat. No. 6,405,453 (which is incorporated herein by reference) is connected in line 49. This controller 55, which is fastened to the front face of housing 2 (FIG. 1) serves to activate and deactivate the blower motor 16*a*, the basket motor 6*a*, the ozone source 10, and the heating unit 22. The timer control includes three switches 62, 64 and 66 which are positioned in lines 50, 54 and 56, respectively. The switch 62, when closed, activates a forward relay FW which will close the contacts 41–43, thereby activating the basket motor to rotate in a first direction. The switch 64, when closed, activates a reverse relay RV which will close the contacts 44–46, thereby activating the basket motor to rotate in a second direction, opposite to the first direction. Lastly, the switch 66, when closed, activates the fan relay FC, which will close the contacts 28–30 to activate the fan motor 16*a*. The fan relay FC when activated also closes a contact 68 to activate a variable speed fan drive 69. The variable speed drive will govern the speed at which the fan motor 6*a* operates, and hence, the speed of the blower 16. The variable speed fan drive is optional.

Additionally, a line 70 extends from line 50. An air switch 72, an ozone/heat switch 74 and a ozone/heat selector switch 76 are positioned in the line 70. The air switch 72 is located in the lower chamber 3 and is preferably a mechanical switch which closes when air is flowing through lower chamber 3.

The line 70 terminates at an ozone/heat selector switch. The switch 76 has two contacts—a heat contact 76*a* and an ozone contact 76*b*. A line 78 extends between the heat contact 76*a* and the line SL2. The heat source 22 is positioned in this line 78 to be activated by the controller 55 when the air switch 72 and ozone/heat switch 74 are closed and when the switch 76 is set to select the heater. Lines 80 and 82 extend in parallel from the ozone contact 76*b* of the ozone/heat selector switch to the line SL2. The ozone source 10 is operably positioned in the line 80 and a speed relay SR is positioned in line 82. The speed relay 82 is in communication with a normally closed contact 84 of the variable speed fan drive 69. Hence, the ozone source 10 and the relay SR are activated and deactivated by the controller 55 when the air switch 72 and ozone/heat switch 74 are closed and when the switch 76 is set to select the ozone.

The circuit 26 is also provided with a rotation sensor 85 and a temperature sensor 86. The temperature sensor is used by the controller during a heating cycle to activate and deactivate the heater to maintain the temperature of the heated air (i.e., the heated air which enters the lower chamber and hence the basket of clothing) at a desired set point. The rotation sensor 85 emits a signal to the controller which the controller can use to determine the rotational speed of the basket. If the basket is rotating too quickly or too slowly, the controller will open the ozone/heat switch 74 to deactivate the heater 22 or the ozone source 10.

Although not shown in the drawing, the controller 55 also includes a timer, so that the motors 6*a* and 16*a*, the heating unit 22 and the ozone source 10 can be deactivated after determined time periods.

The selector switch 76 allows for the tumbler 1 to be operated in a drying cycle or in an ozone treatment cycle. To operate the tumbler as a dryer, the selector switch 76 is set to dryer, so that line 78 receives power. The operator can then activate a start switch (not shown) to begin the cycle. As can be appreciated, before the cycle can start, the lint door switch 58 and the door switch 60 must be closed. When the switches 58 and 60 are closed, power will be supplied to lines 50, 54 and 56. The controller 55 will control the switches 62, 64 and 66 to activate the basket motor 6*a* and the fan motor 16*a*. In the drying cycle the fan motor is operated at its high speed. Once the fan motor is started, the blower will begin to cause the air stream to move from the tumbler inlet, through chamber 4 and the basket 6 and out the exhaust 18. The air flow through the chamber 4 will close the air switch 72 in line 70. Once the controller 55 determines that the line 70 has been powered, the controller can close the ozone/heat switch 74 to provide power to the heat source 22. Thus, the heater will not be activated to heat incoming air until air is flowing through the chamber 4 and basket 6. The controller 55 uses the signals from the temperature sensor 86 to open and close the ozone/heat switch 74 to maintain the temperature of the air stream at a desired set point. At the end of the drying cycle (i.e., after a predetermined or operator selected period of time), the controller deactivates the heating unit 22 and activates the ozone source 10 by moving switch 76 from contact 76*a* to contact 76*b*. The drying cycle can include a cool down period, as is known in the art. The control of the dryer cycle can be performed as disclosed in U.S. Pat. No. 6,405,453, which is incorporated herein by reference.

To operate the tumbler in an ozone cycle to remove smoke odors from clothing, the selector switch 76 is set to select the ozone cycle. As with the drying cycle, the ozone cycle is initiated after the operator place dry clothing in the basket, closes the lint door and tumbler door to close the lint door switch 58 and the door switch 60, and presses the start button. The initiation of the cycle will supply power to the controller to enable the controller to close the fan switch 66 to activate the blower motor 16*a* to begin the flow of air through the tumbler. The controller will also close one of the switches 62 and 64 to activate the basket motor to begin rotating the basket 6 to tumble the clothes within the basket. The air flow through the tumbler will close the air switch 72 to provide power to the ozone/heater controlling aspect of the controller 55. Once the air switch 72 is closed, the controller will close the ozone/heat switch 74. The controller will wait a predetermined period of time for the air switch 72 to close. For example, the air switch 72 can close in about 5 seconds. Thus, the ozone source 10 will not be activated to release ozone into the chamber 4 unless air is flowing through the tumbler. If the ozone source 10 is a tank of ozone, then the closing of the air and ozone switches 72 and 74 can open a valve to allow the ozone tank to release ozone into the housing upper chamber 4. If the ozone source is an ozone generator, then the closing of the switches 72 and 74 will activate the ozone generator.

At the end of the ozone cycle, the controller 55 opens the ozone/heat switch 74 to deactivate the ozone source, but maintains the basket switch (62/64) and the fan switch 66 closed for a period of time, such as about 5 minutes, to continue air flow through the rotating basket to purge ozone from the basket. After this predetermined period of time, the basket and fan switches are opened, to deactivate the fan motor 16*a* and basket motor 6*a*. Thus, at the end of a cycle, ambient air will continue to pass through the basket to purge the basket of ozone. Hence, when the tumbler door is opened at the end of a cycle, there will be substantially no ozone in the tumbler chamber 3.

In the ozone cycle, the controller 55 also controls relay SR. Relay SR is in operative communication with the contact 84 of the variable speed drive 69. When the ozone/heat switch 74 is closed, the relay SR is activated to open the normally closed contact 84, so that the blower motor will be operated in its low speed. When the switch 74 is opened at the end of the ozone treatment time, the relay SR is deactivated, thereby closing the contact 84, so that the fan motor 16*a* will run at its high speed during the purge cycle. The contact 84 is shown as a normally closed contact. However, depending on the motor configuration, it could alternatively be a normally open contact. As can be appreciated, what is desired is that the relay SR opens and closes the contact 84 so that the blower motor 16*a* operates at a low speed while the ozone source is activated and at a high speed during the purge period (i.e., when the ozone source is deactivated).

As can be appreciated, the controller will be receiving signals from the temperature sensor 86 during the ozone treatment cycle. So that controller does not open the ozone/heat switch 74 in response to a signal from the temperature sensor during an ozone treatment cycle, the controller is provided with a set temperature sufficiently high so that the controller will maintain the switch 74 closed during the ozone treatment cycle.

At the beginning of the ozone cycle, the operator can also set the ozone exposure time (i.e., the length of time the air and ozone switches are closed) and the purge time. The ozone exposure time and purge time can be varied depending on the level of odor in the clothing and the type of fabric from which the clothing is made. For example, clothing having a very high smoke odor would require a greater exposure time to the ozone than clothing having a lower amount of smoke odor. Similarly, the purge time (i.e., the amount of time the fan operates after the ozone source is deactivated) can vary with odor level of the clothing. The exposure and purge times can be set on a control panel of the tumbler housing 2. We have found that even clothing having a strong or heavy smoke odor can be deodorized in less than 50 minutes. Clothing with a light smoke order can be deodorized in 30 minutes or less. The purge time can be about 10 minutes for clothing which had a heavy smoke odor and about 3 minutes for clothing having a light smoke odor. As can be appreciated, the total cycle time of about 60 minutes is substantially less than the 24–48 hours that is required by currently available deodorizing equipment, and allows for the treatment of a greater amount of clothing in a shorter period of time.

During the ozone exposure cycle, the ozone source will release ozone such that there is about 0.5 to about 0.125 mg of ozone per cubic foot of air. This amounts to passing about 5000–25000 mg/hr of ozone through the basket 6. According to another basis, about 125 mg of ozone per hour per pound of clothing passes through the chamber during the ozone treatment cycle. The air flow rate though the basket is about 3 to about 10 cfm per lb of clothing to be treated. As can be appreciated, the flow rate of air through the tumbler will depend on the size of the tumbler.

The tumbler 1 described above and shown in the drawings includes a heater. The tumbler can be provided without the heater 22 if desired. In such an instance, the selector switch 76 and the line 78 would be removed from the control circuit. The tumbler is described such that it operates in a drying cycle or in a ozone treatment cycle. The controller could be designed to allow for delivery of heated air during the ozone cycle (i.e., such that the heater 22 and the ozone source 10 are both activated at the same time). Further, the controller could be set to enable the tumbler to automatically start an ozone treatment cycle at the end of a drying cycle. These alternatives could be selected by providing additional contacts for the selector switch 76.

As various changes could be made in the above constructions without departing from the scope of the invention, it is intended that all matter contained in the above description or shown in the accompanying drawings shall be interpreted as illustrative and not in a limiting sense. For example, although the tumbler is described to have an upper chamber and a lower chamber, the tumbler could be constructed to have a single chamber that contains the basket, the blower, and the motors and into which ozone is directly introduced. If an ozone generator is used, the ozone generator would then be positioned within this single chamber. The controller could also be provided with a sensor, such as a humidity sensor, to allow the drying cycled to be ended after a determined humidity level is reached, rather than after a determined time period has elapsed.

The invention claimed is:

1. A process for removing smoke odors from fabric comprising:

drying fabrics to be treated, if necessary such that the fabrics are dry prior to ozone treatment;

rotating a chamber containing the dried fabrics which had previously been placed therein to tumble the dried fabrics contained in the chamber;

introducing ozone into the rotating chamber;

subjecting said dried fabrics to an ozone treatment cycle while said fabrics are tumbled in said chamber; and deodorizing the dried fabrics during the ozone treatment cycle by subjecting the dried fabric in the rotating chamber to the ozone ($O_3$) while the dried fabrics are tumbled in the chamber.

2. The process of claim 1 wherein the chamber comprises a basket; the step of tumbling of the fabric in the chamber comprising rotating the basket.

3. The process of claim 2 the step of subjecting the fabric to ozone comprises passing an air stream containing ozone into and through the rotating basket.

4. The process of claim 3 wherein the step of subjecting the fabric to ozone comprises passing 5000–25000 mg/hr ozone through the rotating basket.

5. The process of claim 3 wherein the step of subjecting the fabric to ozone comprises passing about 125 mg of ozone an hour per pound of fabric through the rotating basket.

6. The process of claim 3 wherein the air stream flows at a rate of about 3 to about 10 cfm per lb of fabric to be treated.

7. The process of claim 3 comprising activating an ozone source to release ozone into the air stream after flow of air through the rotation of the basket has started.

8. The process of claim 3 comprising a step of continuing passing ambient air into and through said basket for a determined purge time period after the ozone source has been deactivated.

9. The process of claim 8 comprising changing the speed of the air stream through the basket after said ozone source has been deactivated.

10. The process of claim 8 comprising continuing rotating of said basket to continue tumbling of the fabric during the purge time period.

11. A clothing tumbler for deodorizing smoke contaminated fabric; said tumbler comprising:

a housing having an air inlet and an exhaust;

a perforated basket mounted in the housing to be rotated by a basket drive;

a blower mounted in the housing to be rotated by a blower drive; the blower, when activated, urging an air stream through an air flow path, said air flow path extending from the air inlet, through the perforated basket, and out the exhaust; and, an ozone source, said ozone source being in fluid communication with said air flow path to introduce ozone in to the air flow path at a point prior to the the basket when activated.

12. The tumbler of claim 11 wherein the ozone source is a tank of ozone or an ozone generator.

13. The tumbler of claim 10 wherein said ozone source releases about 125 mg of ozone per hour per pound of fabric into the basket.

14. The method of claim 11 wherein the ozone source releases about 125 mg of ozone an hour per pound of fabric to be treated into the air flow path when activated.

15. The tumbler of claim 11 wherein said blower urges about 3 to about 10 cfm of air to pass through said basket per pound of fabric in the basket.

16. The tumbler of claim 11 including a controller, said controller being in communication with said ozone source, said blower drive and said basket drive to activate and deactivate said ozone source, said blower drive and said basket drive; wherein said controller does not activate said ozone source until after said blower has been activated.

17. The tumbler of claim 16 comprising an air switch, said air switch detecting the passage of air through said tumbler.

18. The tumbler of claim 16 wherein said controller deactivates said source of ozone after a determined period of time and continues to operate said blower for a determined period of time after said ozone has been deactivated.

19. The tumbler of claim 16 wherein the ozone source is a tank of ozone, said tank being located externally of the tumbler housing; said tumbler comprising a connector to which tank is operably connected and a valve; said valve being controlled by said controller to be moved between an opened position in which ozone can flow from said tank and a closed position in which ozone is prevented from flowing from said tank.

20. The tumbler of claim 16 wherein said ozone source is an ozone generator; said ozone generator being in electrical communication with said controller to be activated and deactivated by said controller.

21. The tumbler of claim 11 including a heating unit; said tumbler being selectively switchable between a heating cycle and an ozone treatment cycle.

22. The process of claim 1 further including a step of mixing the ozone with dehumidified air.

23. The process of claim 22 wherein the step of mixing the ozone with dehumidified air is performed prior to, or upon introduction of, the ozone into the chamber.

24. The process of claim 1 further including a step of drying the fabric in the chamber prior to introducing ozone into the chamber.

25. The tumbler of claim 11 and further including an air dehumdifiying unit; said air dehumidifying unit being in communication with said basket to introduce dehumidified air into the basket.

26. The tumbler of claim 11 and further including a controller in communication with said heating unit and said ozone source to activate and deactivate said heating unit and said ozone source; said controller activating said ozone source to initiate an ozone treatment cycle after a drying cycle has ended and after said heating unit has been deactivated.

* * * * *